US009131553B2

(12) United States Patent
Chen et al.

(10) Patent No.: US 9,131,553 B2
(45) Date of Patent: Sep. 8, 2015

(54) LED DRIVER

(71) Applicant: Silergy Semiconductor Technology (Hangzhou) LTD, Hangzhou, ZheJiang Province (CN)

(72) Inventors: Jun Chen, Hangzhou (CN); Hongfeng Fan, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 307 days.

(21) Appl. No.: 13/892,197

(22) Filed: May 10, 2013

(65) Prior Publication Data

US 2013/0328496 A1 Dec. 12, 2013

(30) Foreign Application Priority Data

Jun. 6, 2012 (CN) ..... 2012 1 0186820

(51) Int. Cl.
*H05B 37/02* (2006.01)
*H05B 33/08* (2006.01)

(52) U.S. Cl.
CPC ..... *H05B 37/0281* (2013.01); *H05B 33/0815* (2013.01); *H05B 33/0851* (2013.01)

(58) Field of Classification Search
CPC ..... H05B 37/0281; H05B 41/3925; H05B 41/2828; H05B 41/28
USPC ..... 315/224, 186, 307, 291, 308; 323/282
See application file for complete search history.

(56) References Cited

U.S. PATENT DOCUMENTS

| | | | | |
|---|---|---|---|---|
| 7,145,295 | B1 * | 12/2006 | Lee et al. | 315/291 |
| 7,816,898 | B2 | 10/2010 | Wong | |
| 8,878,460 | B2 * | 11/2014 | Lu | 315/307 |
| 2009/0167276 | A1 * | 7/2009 | Chiang et al. | 323/288 |
| 2011/0001434 | A1 * | 1/2011 | Hsu et al. | 315/186 |
| 2013/0307435 | A1 * | 11/2013 | Takagimoto et al. | 315/224 |

FOREIGN PATENT DOCUMENTS

CN 102035169 A 4/2011

* cited by examiner

*Primary Examiner* — Lincoln Donovan
*Assistant Examiner* — Thomas Skibinski
(74) *Attorney, Agent, or Firm* — Michael C. Stephens, Jr.

(57) ABSTRACT

An LED driver described herein can determine whether it is operating in z soft-start process by comparing a first threshold value and a soft-start reference value. In the soft-start process, the inductor current and the LED driving current can be soft-started periodically to effectively avoid current overshoot. In addition, the end of the soft-tart operation can be controlled based on a comparison result of the first threshold value and the reference value of the soft-start, and without any external settings. Thus, the end of soft-start operation can automatically be determined with strong controllability.

8 Claims, 10 Drawing Sheets

LED DRIVER

RELATED APPLICATIONS

This application claims the benefit of Chinese Patent Application No. 201210186820.5, filed on Jun. 6, 2012, which is incorporated herein by reference in its entirety.

FIELD OF THE INVENTION

The present invention generally relates to an LED driver, and more particularly to an LED driver with a soft-start function.

BACKGROUND

Traditional light-emitting diode (LED) drivers typically utilized a current control mode with relatively fast dynamic response and good regulation. However, LED driver circuits using this mode of operation may also need to use a soft-start circuit during an initial start up stage to control output voltage and inductor current to change relatively slowly. In this way, a relatively smooth start of the circuit can occur such that output voltage overshoot and surge current through the devices can be substantially prevented or minimized.

SUMMARY

In one embodiment, a light-emitting diode (LED) driver, can include: (i) a soft-start control circuit, where when a first threshold value is less than a soft-start reference value, the LED driver is configured to operate in a soft-start process, where the soft-start reference value represents a desired output current of the LED driver, and where an inductor current of the LED driver is no greater than a second threshold value; (ii) where during a first time interval of the soft-start process, an LED driving current is configured to be maintained at a first current value, and an LED driving voltage rises in a slope-shape, where the first threshold value is maintained at a corresponding initial soft-start value of the first current value, and the second threshold value rises in a slope-shape; (iii) where during a second time interval of the soft-start process, the LED driving current is configured to rise in a slope-shape, and the LED driving voltage is configured to be maintained at an end state of the first time interval, where the first threshold value continues to rise in a slope-shape, and reaches a first final value at an end of the second time interval, and where the second threshold value is maintained at a second final value; and (iv) when the first threshold value is greater than the soft-start reference value, the LED driver is configured to operate in a normal operating state, and the LED driving current is substantially consistent with the desired output current.

Embodiments of the present invention can advantageously provide several advantages over conventional approaches. For example, particular embodiments can provide an LED driver that can determine whether the LED driver is operating in a soft-start process by comparing a first threshold value and a soft-start reference value. During the soft-start procedure, an inductor current of the LED driver and the LED driving current can be soft-started to prevent overshoot. Other advantages of the present invention may become readily apparent from the detailed description of preferred embodiments below.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set fourth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

Figure 1:
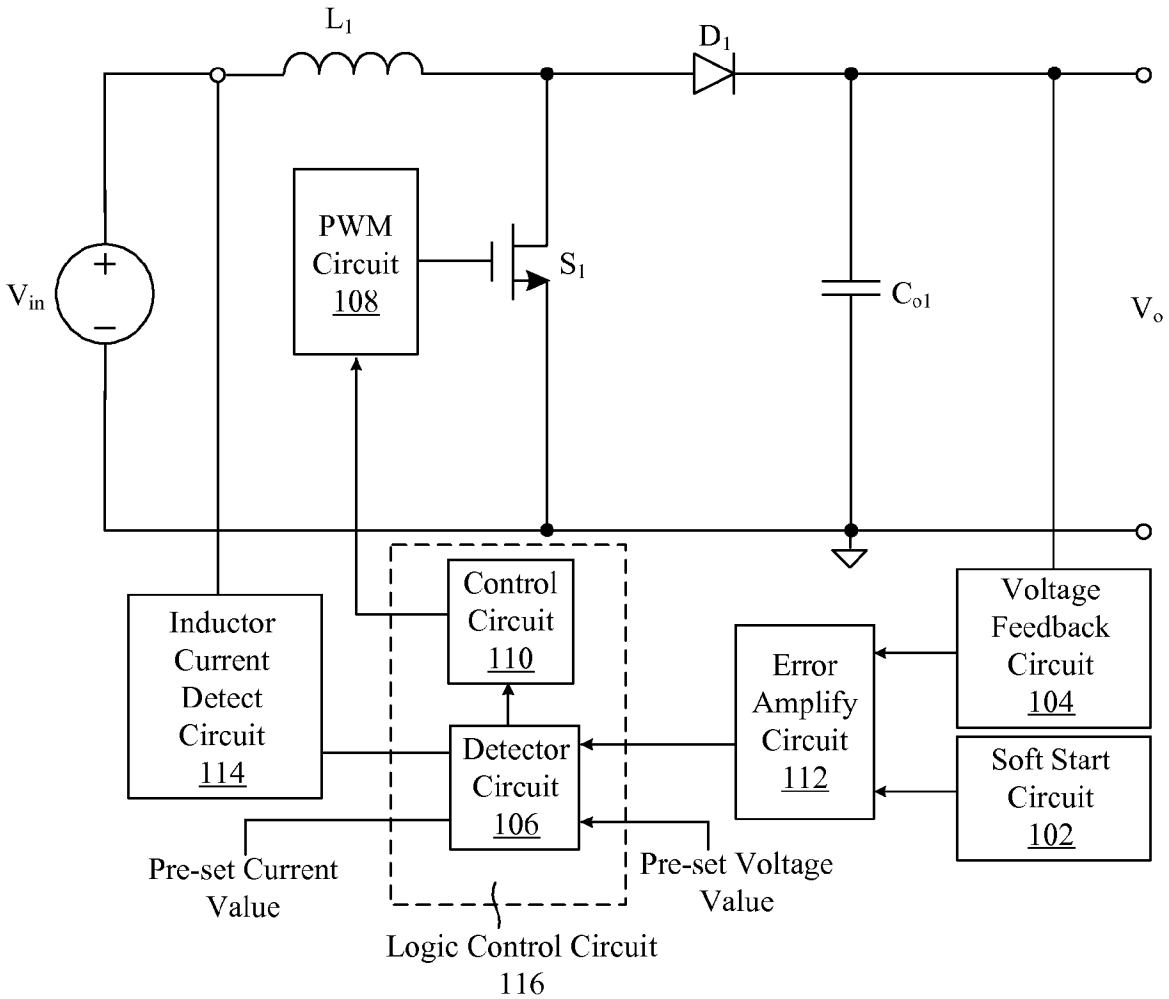
FIG. 1 shows a voltage conversion circuit with a soft-start function.

FIG. 1 shows an example boost DC/DC converter and a logic control circuit. One example of such a structure can be found in Chinese patent application CN101841238A. During a start-up procedure, soft-start circuit 102 can generate a reference voltage for voltage feedback circuit 104 via a current source charging a capacitor. When detector circuit 106 (of logic control circuit 116) detects that an inductor current (e.g., via inductor current detect circuit 114) reaches a predetermined current, or a difference between a reference voltage generated by charging the capacitor and a feedback voltage generated by voltage feedback circuit 104 (e.g., via error amplifier circuit 112) reaches a predetermined voltage, a pulse-width modulated (PWM) signal of PWM circuit 108 can be dynamically adjusted by control circuit 110, so that power switch $S_1$ of a main circuit can be turned off or on for at least one cycle.

In this way, the inductor current can flow into the output. For example, the inductor current can decrease rapidly and begin to rise again from a relatively smaller value in the next cycle, so as to avoid inductor current overshoot. Also, after energy on the inductor is released via the output terminal, the output voltage may accelerate increasing to reduce a difference between the feedback voltage and the reference voltage. This can reduce the duty cycle of power switch $S_1$, may slow the rise of the inductor current, and can't accelerate the rise of the output voltage. When the start-up procedure is over, the soft-start circuit can select a standard reference voltage as a reference voltage of voltage feedback circuit 104.

This particular example circuit can prevent the inductor current and output voltage from overshooting, but may still have some drawbacks. For example, during the soft-start procedure, since the power switch may be turned off or on for at least one cycle, there may be changes in the inductor current, and the circuit may be restarted. Also, while the end of the soft-start process may be controlled through an external start-up signal, the start-up ending may not be easy to control overall.

In one embodiment, a light-emitting diode (LED) driver, can include: (i) a soft-start control circuit, where when a first threshold value is less than a soft-start reference value, the LED driver is configured to operate in a soft-start process, where the soft-start reference value represents a desired output current of the LED driver, and where an inductor current of the LED driver is no greater than a second threshold value; (ii) where during a first time interval of the soft-start process, an LED driving current is configured to be maintained at a first current value, and an LED driving voltage rises in a slope-shape, where the first threshold value is maintained at a corresponding initial soft-start value of the first current value, and the second threshold value rises in a slope-shape; (iii) where during a second time interval of the soft-start process, the LED driving current is configured to rise in a slope-shape, and the LED driving voltage is configured to be maintained at an end state of the first time interval, where the first threshold value continues to rise in a slope-shape, and reaches a first final value at an end of the second time interval, and where the second threshold value is maintained at a second final value; and (iv) when the first threshold value is greater than the soft-start reference value, the LED driver is configured to operate in a normal operating state, and the LED driving current is substantially consistent with the desired output current.

Figure 2:
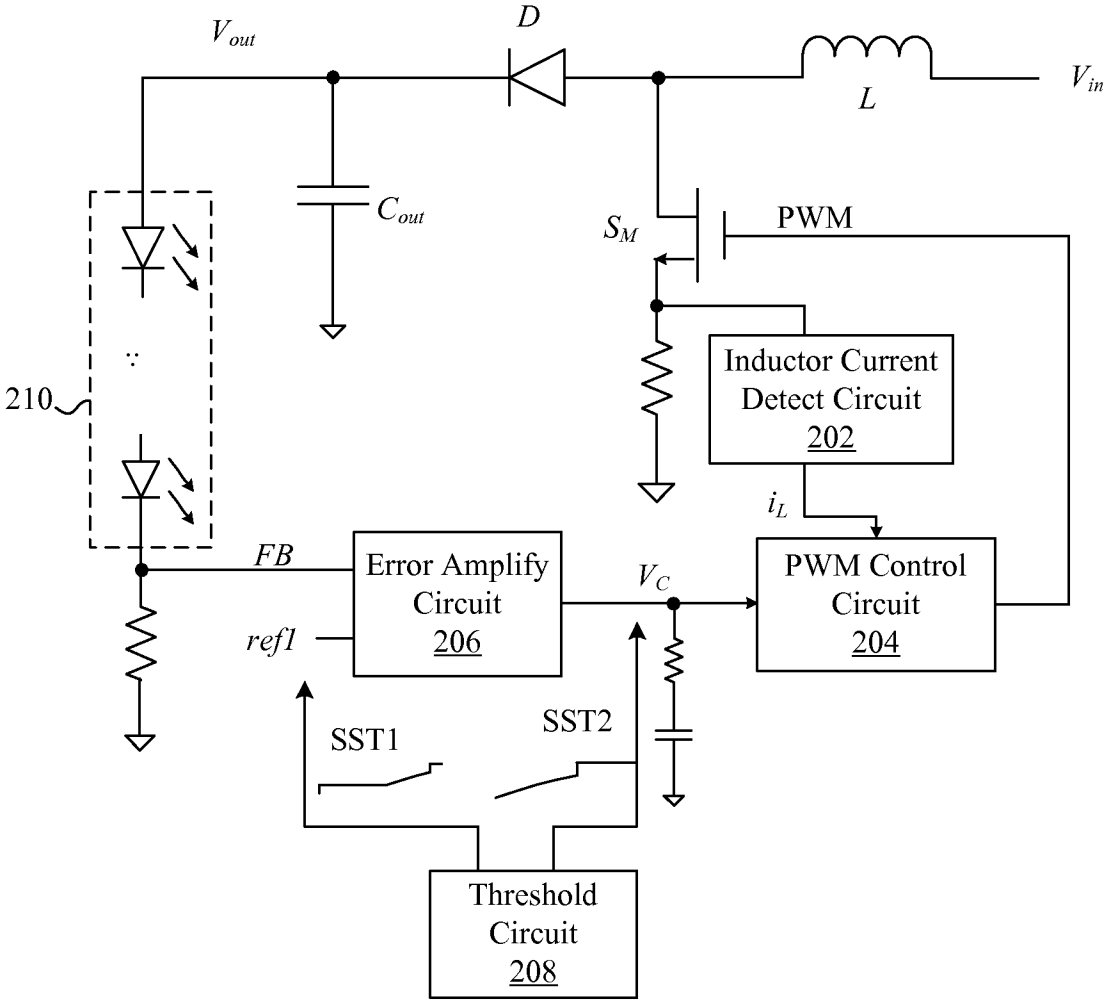
FIG. 2 shows a block diagram of a first example LED driver in accordance with embodiments of the present invention.

Referring now to FIG. 2, shown is a schematic diagram of a first example LED driver in accordance with embodiments of the present invention. For example, the topology of a corresponding main circuit can be a boost circuit that can include inductor L, diode D, switch $S_M$, and output capacitor $C_{out}$. The LED driver for driving one of more LEDs 210 can also include error amplifier circuitry 206 and pulse-width modulation (PWM) control circuit 204. Error amplifier 206 can compare LED current feedback signal FB against reference signal ref1, and an output signal thereby can charge a capacitor to obtain error signal $V_C$. PWM control circuit 204 can receive error signal $V_C$ and inductor current $i_L$ of the LED driver (e.g., via inductor current detect circuit 202), and may accordingly output a PWM signal to control a duty cycle of power switch $S_M$ in the main circuit.

In order to prevent overshoot of inductor current $i_L$ and the LED driving current, this particular example LED driver can include thresholds SST1 and SST2 (e.g., generated via threshold circuit 208), and a soft-start reference value. The soft-start reference value can characterize a desired output current of the LED driver. In this example, reference signal ref1 may be configured as the soft-start reference value. For example, inductor current $i_L$ can be no greater than threshold value SST2. Of course, more than two thresholds can also be generated by threshold circuit 208 in some cases.

Figure 3:
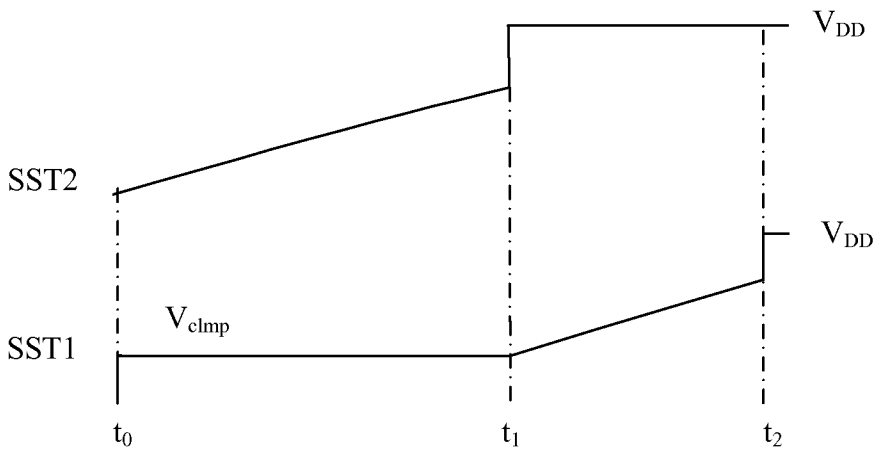
FIG. 3 is an operating waveform diagram showing example first and second thresholds of FIG. 2.

FIG. 3 is an operating waveform showing example thresholds SST1 and SST2. For example, when threshold value SST1 is less than the soft-start reference value, the LED driver may operate in a soft-start process, phase, mode, or state. In a first time interval (e.g., from time $t_0$ to time $t_1$) of the soft-start process, the LED driving current can be maintained at a first current value. For example, the first current value can correspond to and initial soft-start value $V_{clmp}$ of threshold value SST1, and the LED driving voltage can rise in a slope-shape. Threshold value SST1 can be maintained at initial soft-start value $V_{clmp}$, and threshold value SST2 can also rise in a slope-shape.

During a second time interval (e.g., from time $t_1$ to time $t_2$) of the soft-start process, the LED driving current can continue to rise in a slope-shape, and the LED driving voltage can be maintained at an end state of the first time interval. Threshold value SST1 can also continue to rise in a slope-shape, and may reach its final value at the end of the second time interval. Threshold value SST2 can be maintained at its final value for the duration of the second time interval. When threshold value SST1 is greater than the soft-start reference value, the LED driver circuit can be in a "normal" operating state, and the LED driving current can be substantially consistent with the desired output current reference.

As can be seen from FIG. 3, during the first time interval, soft start for inductor current $i_L$ can be carried out. Also, the output voltage at this stage may rise relatively slowly to avoid overshoot of the inductor current and the output voltage, and possible change of the LED current. During the second time interval, soft-start can be carried out for the LED driving current. Since the output voltage in the first time interval has reached a stable value, based on the voltage-current characteristic of the LED, when the LED driving current rises slowly, minor changes can be produced in the output voltage to avoid overshoot.

In particular embodiments, during the process of soft-start, a phased soft-start can occur for the inductor current and the LED drive current. Thus, circuit output voltage, inductor current, and LED driving current overshoot can effectively be suppressed, and a continuous smooth start for the LED driver can be achieved.

Figure 4:
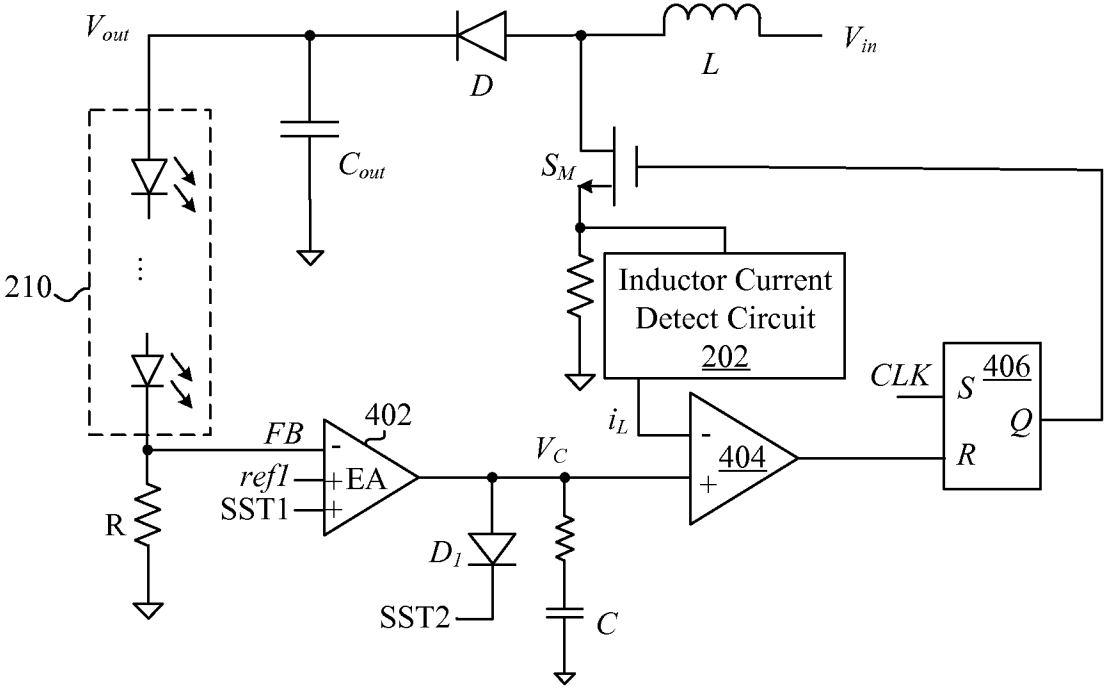
FIG. 4 shows a schematic diagram of a second example LED driver in accordance with embodiments of the present invention.

Referring now to FIG. 4, shown is a schematic diagram of a second example LED driver in accordance with embodiments of the present invention. For example, LED load 210 can be series-connected with resistor R to ground. An output at a common node of LED load 210 and resistor R can be configured as LED current feedback signal FB. Error amplifier (EA) 402 can amplify a relatively small error by comparing LED feedback signal FB and reference signal ref1, and/or by comparing LED feedback signal FB and threshold value SST1, to a provide an output current to charge capacitor C.

Figure 5:
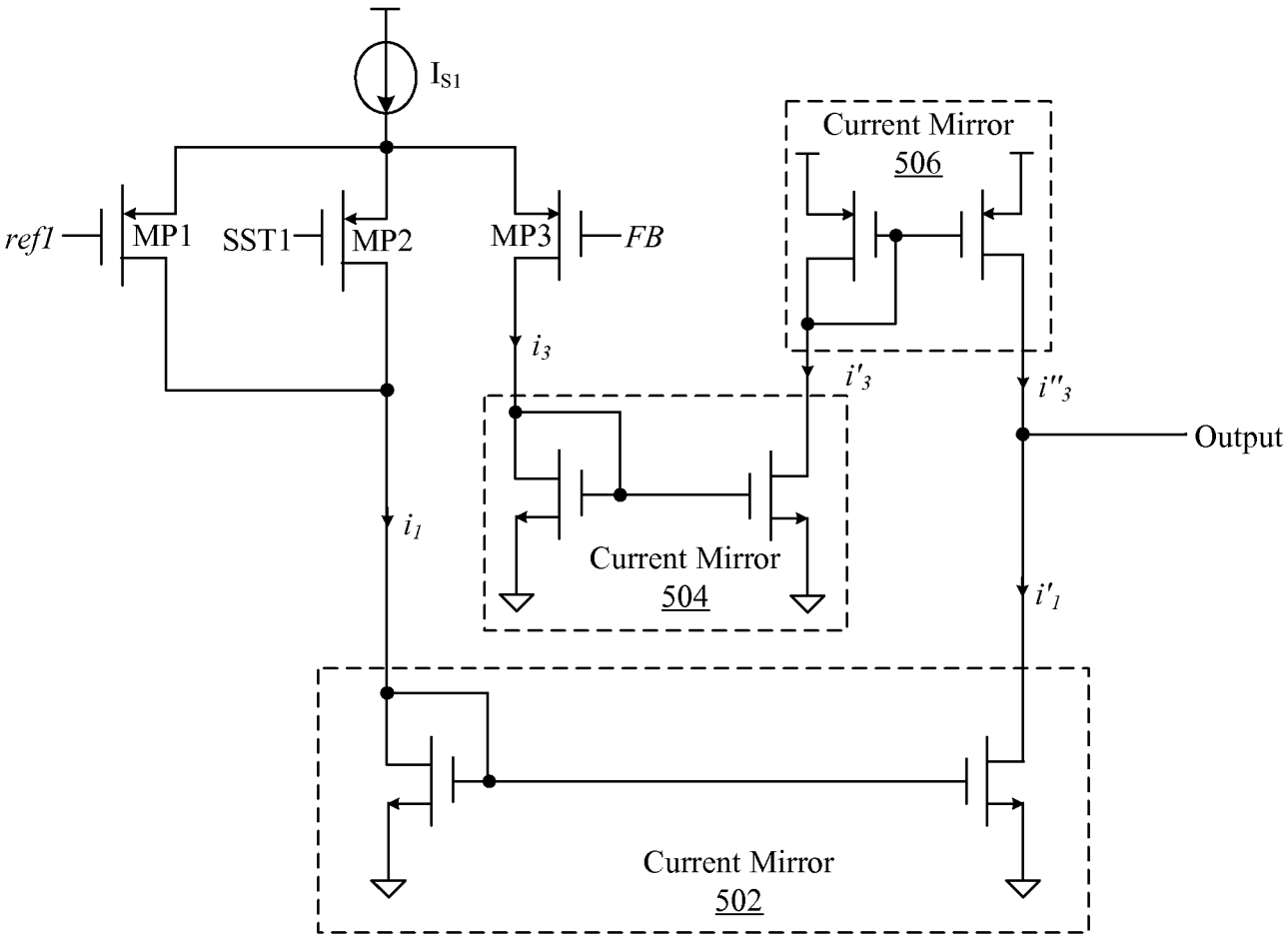
FIG. 5 shows a schematic diagram of an example error amplifier of the LED driver of FIG. 4.

FIG. 5 shows one example implementation of error amplifier 402. In this particular example, error amplifier 402 can include current source $I_{S1}$, P-type MOS transistors MP1, MP2, and MP3, and current mirrors 502, 504, and 506. Reference signal ref1 can be received by the gate of transistor MP1. Threshold value SST1 can be received by the gate of transistor MP2, LED current feedback signal FB can be received by the gate of transistor MP3. Sources of transistors MP1, MP2, and MP3 can connect together to receive the output current of current source $I_{S1}$, and drains of transistors MP1 and MP2 can connect together.

Current mirrors 502 and 504 can each include two N-type MOS transistors, and current mirror 506 can include two P-type MOS transistors. When reference signal ref1 is larger than threshold value SST1, the output current of current source $I_{S1}$ may flow through transistor MP2 rather than transistor MP1. From this, error amplifier 402 can convert the error between LED feedback signal FB and the lower value of reference signal ref1 and threshold value SST1 to the output current. When LED current feedback signal FB is larger than the lower value of reference signal ref1 and threshold value SST1, current $i_3$ flowing through transistor MP3 can be less than output current $i_1$ flowing through the connecting nude of drains of transistors MP1 and MP2.

Current $i_1$ can be mirrored through current mirror 502 to generate mirror current $i'_1$. Current $i_3$ can be mirrored through current mirror 504 to generate current $i'_3$, to further generate mirror current $i''_3$ through the mirroring effect of current mirror 506. The output of error amplifier 402 can be the difference between mirror currents $i''_3$ and $i'_1$. When mirror current $i''_3$ is less than mirror current $i'_1$, capacitor C can be discharged. When mirror current $i''_3$ is greater than mirror current $i'_1$, capacitor C connected to the output of error amplifier 402 can be charged.

Referring back to FIG. 4, error amplifier 402 can charge or discharge capacitor C to obtain error signal $V_C$. Comparator 404 can compare error signal $V_C$ and inductor current $i_L$ (e.g., from inductor current detect circuit 202) to provide a signal to the reset terminal of RS flip-flop 406 to control turn-off of switch $S_M$. The set terminal of RS flip-flop 406 can receive clock signal CLK to control turn-on of switch $S_M$. Also, threshold value SST2 can be used to clamp error signal $V_C$. For example, diode $D_1$ can receive error signal $V_C$ at its anode and threshold value SST2 at its cathode. When error signal $V_C$ is greater than threshold value SST2, diode $D_1$ can be turned on, and error signal $V_C$ can be limited to threshold value SST2.

In this particular example, the soft-start function of the LED driving current can be integrated into error amplifier 402. By utilizing error amplifier 402 to effectively clamp LED current feedback signal FB, the LED driving current can rise slowly but may not to produce overshoot. Also, by utilizing diode $D_1$ to carry out a soft-start operation for error signal $V_C$, the inductor current can also be assured to rise slowly and may not to produce overshoot.

After transiting to the first final value at the end of the first time interval as shown in FIG. 3, threshold value SST1 can be greater than reference voltage ref1, so the soft-start process can complete. When threshold value SST2 is greater than error signal $V_C$, diode $D_1$ can be turned off, which also completes its soft-start function. Thus in particular embodiments, the LED driver can end the soft-start operation automatically without external settings, and with strong controllability. Alternatively, a current source can be used to replace resistor R in series with LED load 210 to obtain LED current feedback signal FB. In addition, the main circuit of the LED driver can have a boost, buck, or any suitable topology.

Figure 6:
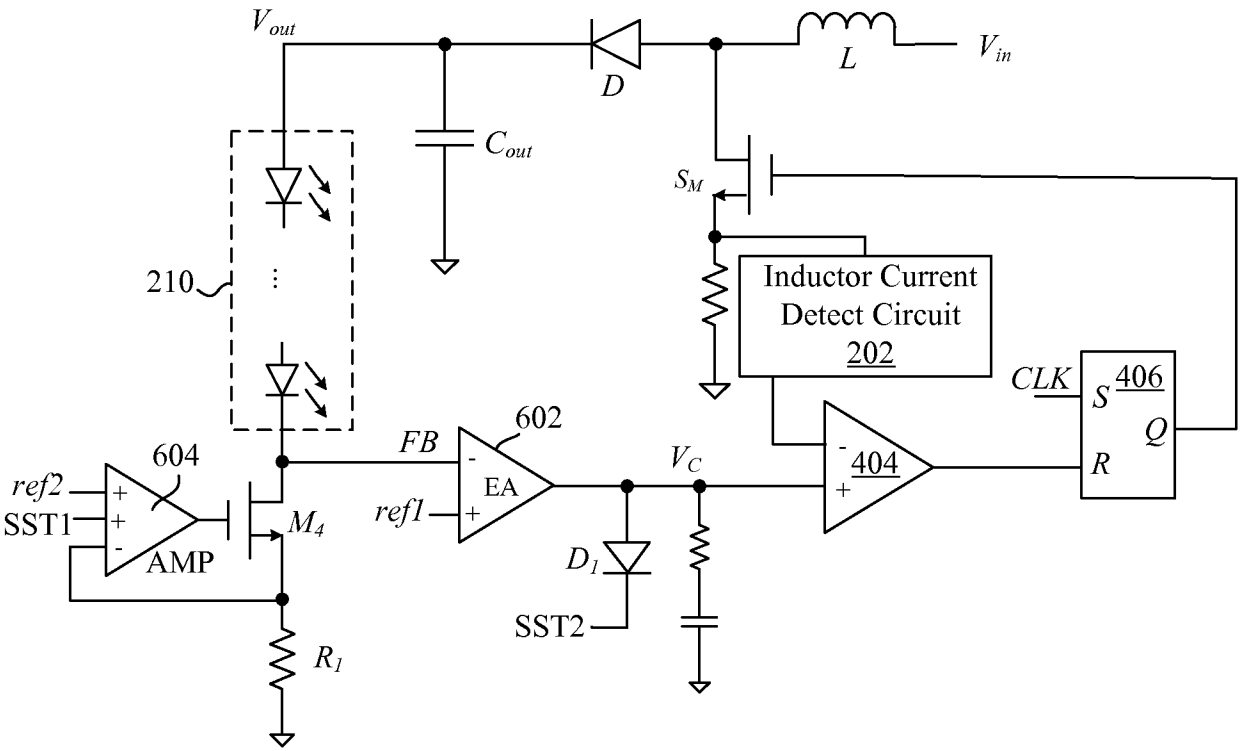
FIG. 6 shows a schematic diagram of a third LED driver in accordance with embodiments of the present invention.

Referring now to FIG. 6, shown is a schematic diagram of a third example LED driver in accordance with embodiments of the present invention. This particular example LED driver can include error amplifier 602, MOS transistor $M_4$, resistor $R_1$, and amplifier (AMP) 604. LED load 210 can be series connected with MOS transistor $M_4$ and resistor $R_1$ to ground. The output at a common node of LED load 210 and MOS transistor $M_4$ can be configured as LED current feedback signal FB.

For example, one implementation of amplifier 604 can be as shown in FIG. 5, except where the gate of P-type MOS transistor MP1 can receive reference signal ref2, and reference signal ref2 can be set as the initial soft-start value. Also, the gate of P-type MOS transistor MP2 can receive threshold value SST1, and the lower value of reference signal ref2 and threshold value SST1 signal can be set as the setting signal. The gate of P-type MOS transistor MP3 can receive the voltage drop as an input at the negative terminal of AMP 604, where the voltage drop can be generated by current of MOS transistor $M_4$ flowing through resistor $R_1$. The output signal of AMP 604 can adjust MOS transistor $M_4$ to control its negative input to track the lower value of reference signal ref2 and threshold value SST1.

Figure 7:
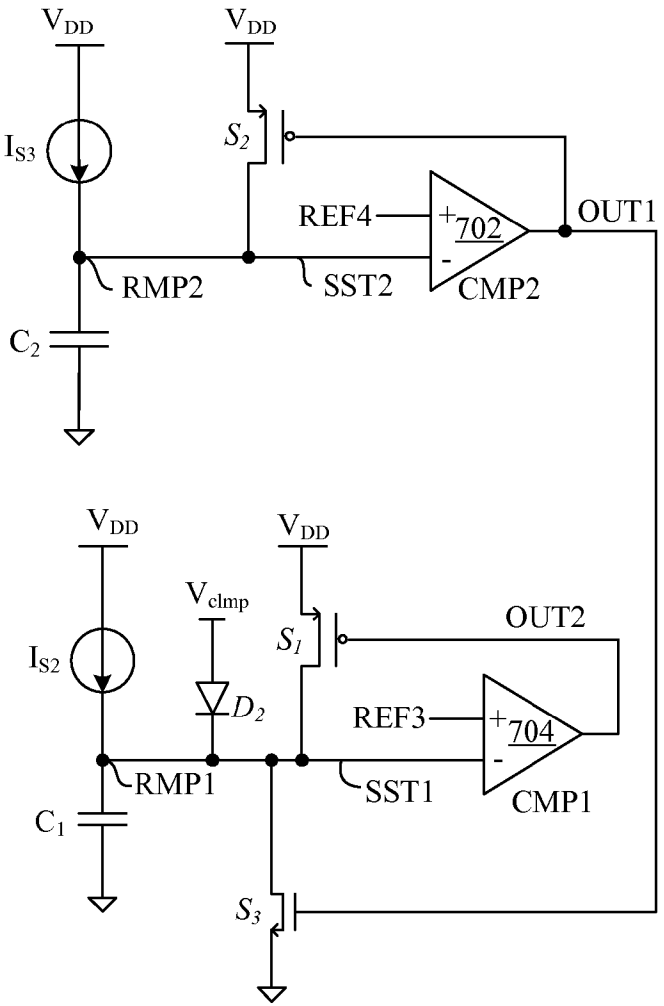
FIG. 7 shows an example threshold value circuit of a LED driver in accordance with embodiments of the present invention.

As shown above in FIG. 2, an LED driver in particular embodiments can also include a threshold circuit 208 for generating the thresholds SST1 and SST2. Referring now to FIG. 7, shown is one example threshold circuit in accordance with embodiments of the present invention. For example, threshold circuit 208 can include a ramp signal generating circuit used to generate a ramp signal to control operation of thresholds SST1 and SST2. Threshold circuit 208 can also include a clamp circuit, where during the first time interval, threshold value SST1 can be clamped at the initial soft-start value $V_{clmp}$. During the second time interval, the threshold value SST2 can be clamped at the second final value (see, e.g., value of SST2 at the end of the second time interval in FIG. 3). Also, at the end of the second time interval, threshold value SST1 can be clamped to the first final value (see, e.g., value of SST1 at the end of the second time interval in FIG. 3). Also, a timing control circuit used to control operation timing of the ramp signal generating circuit and the clamp circuit.

In the example of FIG. 7, the first final value and the second final value can be selected as chip supply voltage $V_{DD}$, and initial start-up value $V_{clmp}$ can be set as, e.g., ⅓ to ⅕ of the first final value according to practical requirements. The clamping circuit can include switch $S_1$, switch $S_2$, and diode $D_2$. For example, switch $S_1$ can be connect between chip supply voltage $V_{DD}$ and an output terminal of threshold value SST1, and switch $S_2$ can connect between chip supply voltage $V_{DD}$ and an output terminal of threshold value SST2.

The anode of diode $D_2$ can connect to the initial soft-start value $V_{clmp}$, and the cathode of diode $D_2$ can connect to an output terminal of threshold value SST1. The ramp signal generating circuit can include ramp signal RMP1 output at a common node of series-connected current source $I_{S2}$ and capacitor $C_1$, and can configured as threshold value SST1. Ramp signal RMP2 output at a common node of series-connected current source $I_{S3}$ and capacitor $C_2$ can be configured as threshold value SST2.

The timing control circuit can include comparator 702, comparator 704, and switch $S_3$. Switch $S_3$ can connect between the cathode of diode $D_2$ and ground. The inverting input terminal of comparator 704 can receive threshold value SST1 and the non-inverting input terminal of comparator 704 can receive reference voltage REF3. The output OUT2 of comparator 704 can control a switching operation of switch $S_1$. The inverting input terminal of comparator 702 can receive threshold value SST2 and the non-inverting input terminal can receive reference voltage REF4. The output OUT1 can control switching operation of switches $S_2$ and $S_3$.

Figure 8:
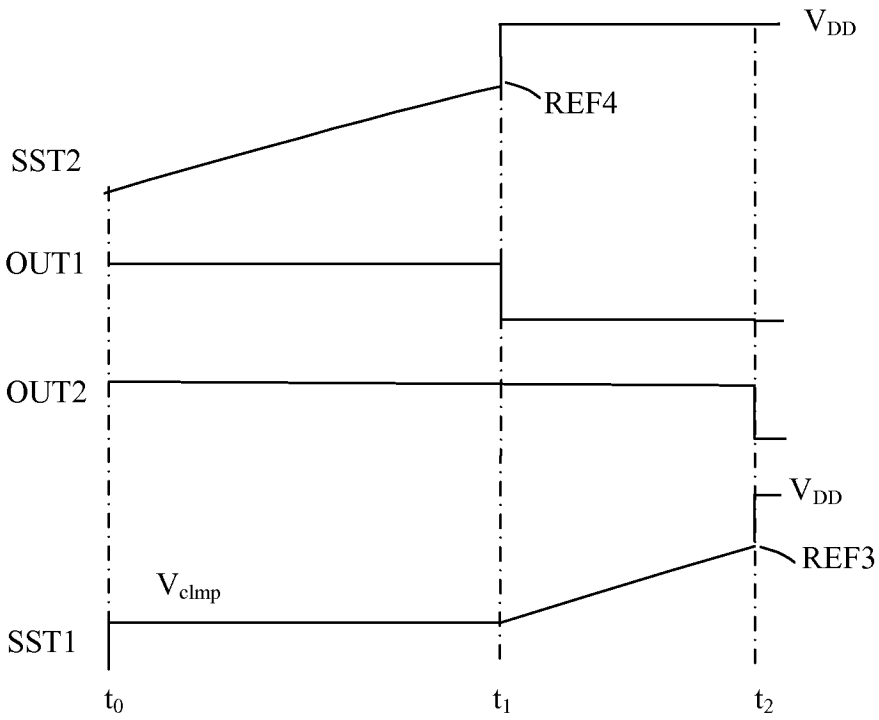
FIG. 8 is an operating waveform diagram showing an example operation of the threshold value circuit of FIG. 7.

FIG. 8 is an example operation waveform diagram showing an example operation of the threshold circuit in FIG. 7. At the initial soft-start moment (e.g., time $t_0$), switches $S_1$ and $S_2$ are both off, and switch $S_3$ is on. Threshold value SST1 can be clamped by diode $D_2$ at initial soft-start value $V_{clmp}$, and current source $I_{S3}$ can start charging capacitor $C_2$. Threshold value SST2 can follow the increasing ramp signal RMP2 gradually until time $t_1$ (e.g., the end of the first time interval). Then, threshold value SST2 can rise to a level of reference voltage REF4. Comparator 702 can output a low signal to control switch $S_2$ to turn on, and to control switch $S_3$ to turn off.

Diode $D_2$ may stop clamping threshold value SST1, and current source $I_{S2}$ can start charging capacitor $C_1$. Threshold value SST1 can follow the increasing ramp signal RMP1 gradually, while threshold value SST2 can be clamped to the second final value (e.g., the chip supply voltage $V_{DD}$) when switch $S_2$ turns on. At the end time of the second time interval (e.g., time $t_2$), first threshold value SST1 can increase to reference voltage REF3, and comparator 704 can output a low signal to turn on switch $S_1$. Then, threshold value SST1 can be clamped to the first final value (e.g., the chip supply voltage $V_{DD}$).

Figure 9:
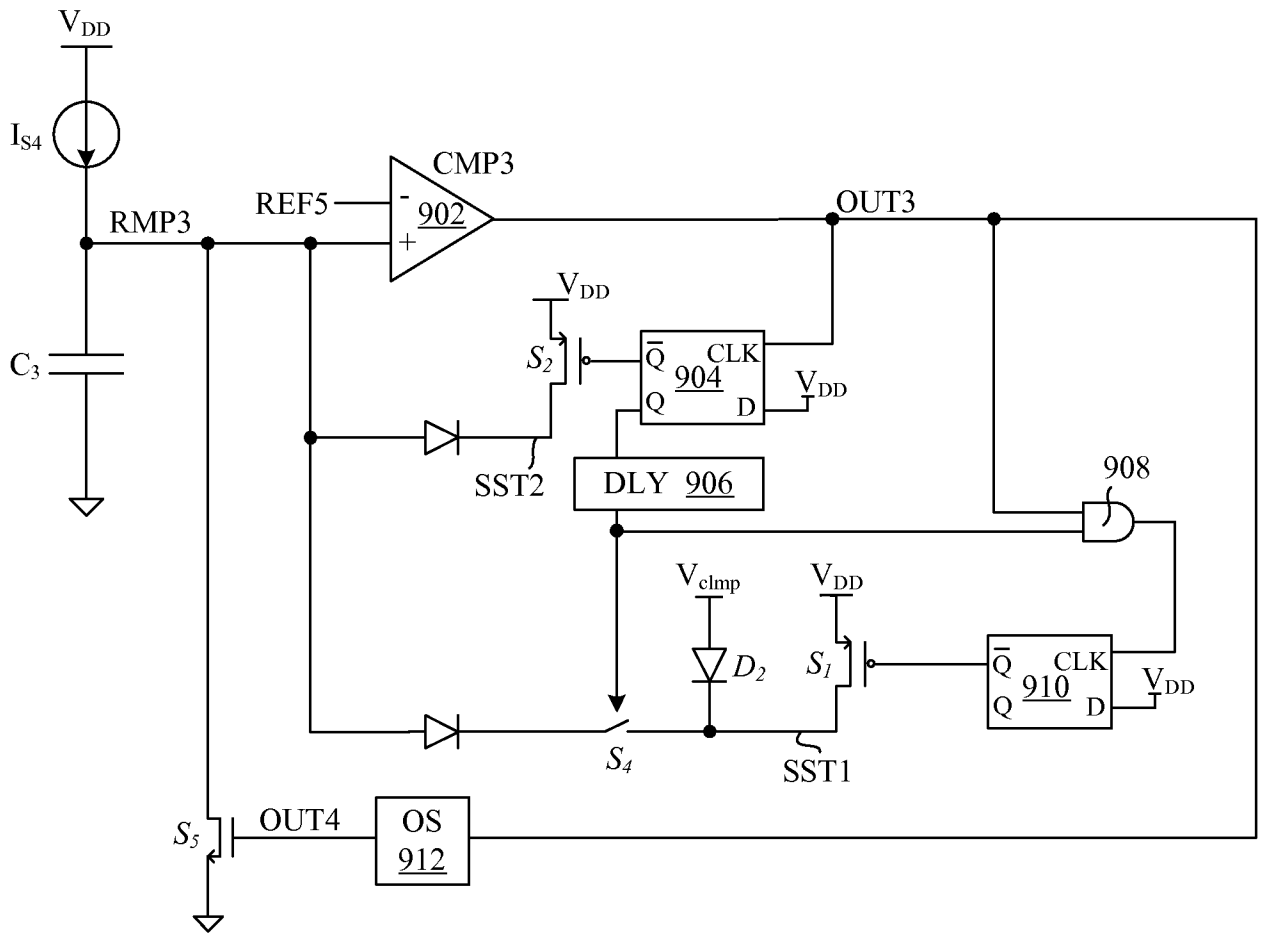
FIG. 9 shows another example of a threshold value circuit in an LED driver in accordance with embodiments of the present invention.

Though the threshold circuit in FIG. 7 has a relatively simple structure, two capacitors used therein may occupy a relative larger chip area, resulting in possibly higher product costs. In order to solve this problem, FIG. 9 shows another implementation of the threshold circuit. The difference between the implementations of FIGS. 7 and 9 is that the ramp signal generating circuit may use only one capacitor in the implementation of FIG. 9. In the example of FIG. 9, the voltage at the common node of series-connected current source $I_{S4}$ and capacitor $C_3$ may be configured as ramp signal RMP3.

Correspondingly, the timing control circuit can include comparator 902, flip-flops 904 and 910, AND-gate 908, delay circuit 906, one-shot (OS) circuit 912, and switches $S_4$ and $S_5$. Switch $S_4$ can connect between an output of threshold value SST1 and a common node of current source $I_{S4}$ and capacitor $C_3$ via a diode. Switch $S_5$ can connect between a terminal of ramp signal RMP3 and ground. The non-inverting input of comparator 902 can receive ramp signal RMP3, and the inverting input of comparator 902 can receive reference voltage reference REF5. The output of comparator 902 can connect to flip-flop 904. When the output of comparator 902 is active, flip-flop 904 can keep switch $S_2$ on, while switch $S_5$ can also be turned on. The output of comparator 902 can be used as a clock signal CLK of flip-flop 904. The D terminal of flip-flop 904 can connect to the chip supply voltage $V_{DD}$, and the inverted output terminal of flip-flop 904 can connect to a control terminal of switch $S_2$.

The Q terminal of flip-flop 904 can output an "activated" signal. The activated signal can be input to AND-gate 908 and to control switch $S_4$ after being processed by delay circuit 906. For example, the delay time of delay circuit 906 can be no less than a pulse width of output signal OUT3 of comparator 902. AND-gate 908 can also receive output signal OUT3 from comparator 902, and the output of AND-gate 908 can connect to flip-flop 910. When the output signal of AND-gate 908 is active, flip-flop 910 can control the switch $S_1$ to be on. The output signal of AND-gate 908 can be clock signal CLK of flip-flop 910, the D terminal of flip-flop 910 can connect to the chip supply voltage $V_{DD}$, and the inverted output terminal of flip-flop 910 can connect to the control terminal of switch $S_1$.

Figure 10:
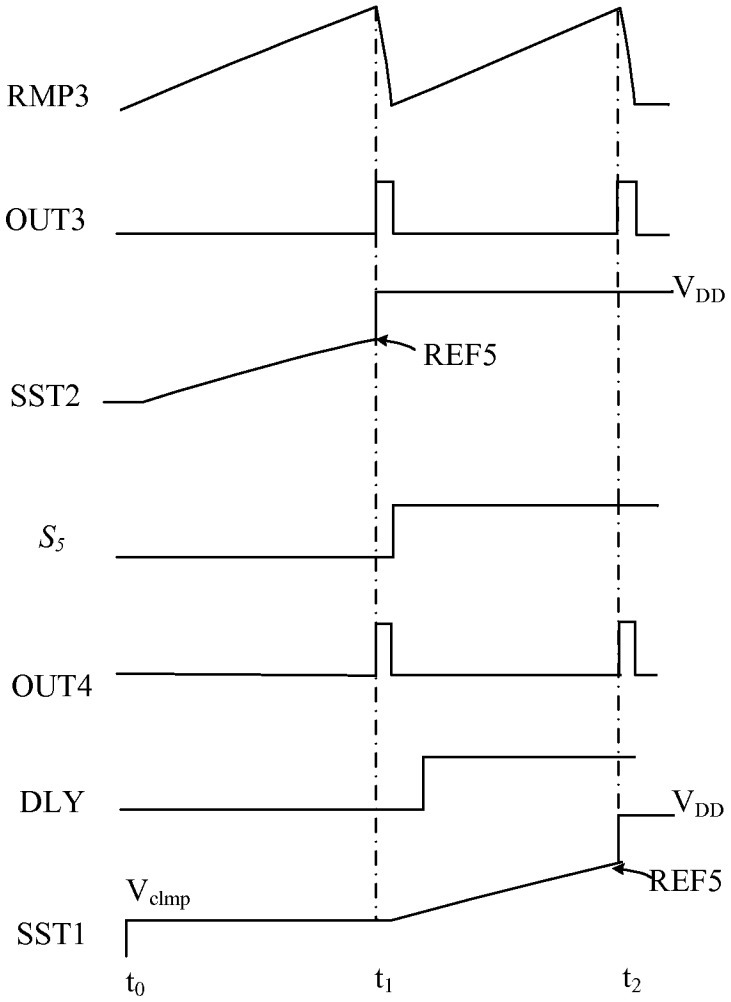
FIG. 10 is an operating waveform diagram showing an example operation of the threshold value circuit of FIG. 9.

FIG. 10 is an example operation waveform diagram showing an example operation of the threshold circuit of FIG. 9. At the initial start-up moment (e.g., time $t_0$), switches $S_1$, $S_2$, and $S_5$ are off, threshold value SST1 can be clamped by diode $D_2$ at initial soft-start value $V_{clmp}$, and current source $I_{S4}$ can start charging capacitor $C_3$. Threshold value SST2 can follow the increasing ramp signal RMP3 gradually until time $t_1$ (e.g., the end of the first time interval). Then, ramp signal RMP3 can rise to a level of reference voltage REF5. Comparator 902 can output a high signal to control switch $S_5$ to turn on via one-shot circuit 912. Thus, ramp signal RMP3 can be pulled down, and the ramp signal generating circuit can be restarted.

Also, the inverted output terminal of flip-flop 904 can output a low level as clock signal CLK becomes high, thereby controlling switch $S_2$ to turn on, and threshold value SST2 can be clamped to the second final value (e.g., chip supply voltage $V_{DD}$). The Q terminal of flip-flop 904 can output a high level as the activated signal after a delay time determined by delay circuit 906, to control switch $S_4$ to turn on, and threshold value SST1 can follow slope signal RMP3 to gradually increase. For example, the delay time of delay circuit 906 can be no less than a pulse width of the output signal of comparator 902, in order to ensure that when output OUT3 of comparator 902 is a low level, the signal provided to AND-gate 908 is a high level, and also to ensure that switch $S_1$ remains off, until the end of the second time interval (e.g., time $t_2$). Then, output OUT3 of comparator 902 can turn to a high level again, the output of AND-gate 908 may also be a high level, thereby controlling the inverted output terminal of 910 flip-flop to output a low level signal to control switch $S_1$ to turn on. Then, threshold value SST1 can be clamped to the first final value (e.g., the chip supply voltage $V_{DD}$).

The foregoing descriptions of specific embodiments of the present invention have been presented through images and text for purpose of illustration and description of the start-up circuit and method. They are not intended to be exhaustive or to limit the invention to the precise forms disclosed, and obviously many modifications and variations are possible in light of the above teaching, such as the variable number of the current mirror and the alternatives of the type of the power switch for different applications.

The embodiments were chosen and described in order to best explain the principles of the invention and its practical applications, to thereby enable others skilled in the art to best utilize the invention and various embodiments with modifications as are suited to the particular use contemplated. It is intended that the scope of the invention be defined by the claims appended hereto and their equivalents.

What is claimed is:

1. A light-emitting diode (LED) driver, comprising:

a) a soft-start control circuit, wherein when a first threshold value is less than a soft-start reference value, said LED driver is configured to operate in a soft-start process, wherein said soft-start reference value represents a desired output current of said LED driver, and wherein an inductor current of said LED driver is no greater than a second threshold value;

b) wherein during a first time interval of said soft-start process, an LED driving current is configured to be maintained at a first current value, and an LED driving voltage rises in a slope-shape, wherein said first threshold value is maintained at a corresponding initial soft-start value of said first current value, and said second threshold value rises in a slope-shape;

c) wherein during a second time interval of said soft-start process, said LED driving current is configured to rise in a slope-shape, and said LED driving voltage is configured to be maintained at an end state of said first time interval, wherein said first threshold value continues to rise in a slope-shape, and reaches a first final value at an end of said second time interval, and wherein said second threshold value is maintained at a second final value; and d) when said first threshold value is greater than said soft-start reference value, said LED driver is configured to operate in a normal operating state, and said LED driving current is substantially consistent with said desired output current.

2. The LED driver of claim 1, wherein said LED driver comprises:

a) an error amplifier configured to generate an error signal by comparing an LED current feedback signal against a first reference signal; and b) a pulse-width modulation (PWM) control circuit configured to receive said error signal and said inductor current, and to output a PWM signal to control a duty cycle of a switch in a main circuit to drive an LED load.

3. The LED driver of claim 2, further comprising an error amplifier having:

a) a first current source, and first, second, and third P-type MOS transistors, wherein said error amplifier is configured to convert an error between a lower value of gates of said first and second P-type MOS transistors against a gate of said third P-type MOS transistor to provide an output current;

b) wherein sources of said first, second, and third P-type MOS transistors are connected together to receive output current from said first current source, and drains of said first and second P-type MOS transistors are connected together;

c) a first mirror circuit configured to convert an output current at drains of said first and second P-type MOS transistors to a first mirror current; and d) a second mirror circuit configured to convert a drain current of said third P-type MOS transistor to a second mirror current, wherein an output of said error amplifier is a difference between said second mirror current and said first mirror current.

4. The LED driver of claim 3, wherein:

a) said LED load is connected in series with a resistor to ground, wherein an output of a common node of said LED load and said resistor is configured as said LED current feedback signal;

b) said first reference signal is received by a gate of said first P-type MOS transistor, and said first reference signal is configured as said soft-start reference value;

c) said first threshold value is received by a gate of said second P-type MOS transistor; and d) said LED current feedback signal is received by a gate of said third P-type MOS transistor.

5. The LED driver of claim 3, further comprising:

a) a fourth MOS transistor coupled in series between said LED load and a first resistor to ground, wherein a common node of said LED load and said fourth MOS transistor is configured as said LED current feedback signal;

b) wherein a second reference signal is received by a gate of said first P-type MOS transistor, and said second reference signal is configured as said soft-start reference value, wherein said first threshold value is received by a gate of said second P-type MOS transistor, and wherein a voltage drop on said first resistor is received by a gate of said third P-type MOS transistor; and c) wherein an output of said error amplifier is configured to regulate said fourth MOS transistor.

6. The LED driver of claim 2, further comprising a first diode having an anode configured to receive said error signal, and a cathode configured to receive said second threshold value.

7. The LED driver of claim 1, wherein a topology of said main circuit of said LED driver comprises a boost topology.

8. The LED driver of claim 1, further comprises a threshold circuit configured to output said first and second threshold values, wherein said threshold value circuit comprises:

a) a ramp signal generating circuit configured to generate a ramp signal to control a rising operation of said first and second threshold values;

b) a clamp circuit, wherein during a first time interval, said first threshold value is clamped at said initial soft-start value, during a second time interval, said second threshold value is clamped at said second final value, and at an end of said second time interval, said first threshold value is clamped to said first final value; and c) a timing control circuit configured to control operating timing of said ramp signal generating circuit and said clamp circuit.

* * * * *